US009353340B2

(12) United States Patent
Kawai et al.

(10) Patent No.: US 9,353,340 B2
(45) Date of Patent: May 31, 2016

(54) ENGINE CLEANING COMPOSITION

(71) Applicants: Hidetoshi Kawai, Toyota (JP); Yoshiharu Hata, Toyota (JP); Takeo Sakurai, Toyota (JP); Hiroyuki Nishiura, Toyota (JP); Masayuki Ichiyanagi, Nagoya (JP); Reika Ogawa, Shizuoka (JP); Shigehiko Sato, Shizuoka (JP); Masaaki Matsunaga, Shizuoka (JP)

(72) Inventors: Hidetoshi Kawai, Toyota (JP); Yoshiharu Hata, Toyota (JP); Takeo Sakurai, Toyota (JP); Hiroyuki Nishiura, Toyota (JP); Masayuki Ichiyanagi, Nagoya (JP); Reika Ogawa, Shizuoka (JP); Shigehiko Sato, Shizuoka (JP); Masaaki Matsunaga, Shizuoka (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/432,006

(22) PCT Filed: Sep. 26, 2013

(86) PCT No.: PCT/JP2013/076068

§ 371 (c)(1),
(2) Date: Mar. 27, 2015

(87) PCT Pub. No.: WO2014/050969

PCT Pub. Date: Apr. 3, 2014

(65) Prior Publication Data

US 2015/0259631 A1 Sep. 17, 2015

(30) Foreign Application Priority Data

Sep. 27, 2012 (JP) ..... 2012-214130

(51) Int. Cl.

| | |
|---|---|
| ***C11D 3/20*** | (2006.01) |
| ***C11D 3/30*** | (2006.01) |
| ***C11D 3/43*** | (2006.01) |
| ***C11D 3/44*** | (2006.01) |
| ***C11D 11/00*** | (2006.01) |
| ***C10M 169/04*** | (2006.01) |
| ***C11D 1/08*** | (2006.01) |
| ***C11D 1/40*** | (2006.01) |
| ***C11D 3/18*** | (2006.01) |
| ***F02B 77/04*** | (2006.01) |
| ***C10M 141/10*** | (2006.01) |
| ***C11D 3/33*** | (2006.01) |
| ***C11D 10/04*** | (2006.01) |
| ***C10L 1/14*** | (2006.01) |
| ***C10L 10/06*** | (2006.01) |
| *C11D 7/26* | (2006.01) |
| *C10L 1/16* | (2006.01) |
| *C10L 1/182* | (2006.01) |
| *C10L 1/185* | (2006.01) |
| *C10L 1/188* | (2006.01) |
| *C10L 1/222* | (2006.01) |

(52) U.S. Cl.

CPC ..... *C11D 11/0041* (2013.01); *C10L 1/14* (2013.01); *C10L 10/06* (2013.01); *C10M 141/10* (2013.01); *C10M 169/04* (2013.01); *C11D 1/08* (2013.01); *C11D 1/40* (2013.01); *C11D 3/187* (2013.01); *C11D 3/2044* (2013.01); *C11D 3/2075* (2013.01); *C11D 3/2082* (2013.01); *C11D 3/30* (2013.01); *C11D 3/33* (2013.01); *C11D 3/43* (2013.01); *C11D 10/047* (2013.01); *F02B 77/04* (2013.01); *C10L 1/1616* (2013.01); *C10L 1/1826* (2013.01); *C10L 1/1852* (2013.01); *C10L 1/1883* (2013.01); *C10L 1/2222* (2013.01); *C10L 1/2225* (2013.01); *C10M 2203/1065* (2013.01); *C10M 2207/022* (2013.01); *C10M 2207/12* (2013.01); *C10M 2207/127* (2013.01); *C10M 2207/129* (2013.01); *C10M 2215/02* (2013.01); *C10N 2230/04* (2013.01); *C10N 2240/10* (2013.01); *C10N 2240/56* (2013.01); *C11D 7/261* (2013.01)

(58) Field of Classification Search

CPC .. C11D 3/2082; C11D 3/2041; C11D 3/2044; C11D 3/30; C11D 3/43; C11D 7/261; C11D 7/263; C11D 7/3209; C11D 7/50

USPC ..... 510/183, 184, 185, 238, 477, 488, 499, 510/505, 506

See application file for complete search history.

(56) References Cited

U.S. PATENT DOCUMENTS

| | | | | |
|---|---|---|---|---|
| 4,321,166 A * | 3/1982 | McGrady | C11D 3/28 510/325 |
| 4,565,547 A | 1/1986 | Takada | |
| 4,807,578 A | 2/1989 | Adams et al. | |
| 5,486,316 A * | 1/1996 | Bershas | C10M 105/22 134/18 |
| 6,278,007 B1 * | 8/2001 | Inaoka | C07C 43/11 554/126 |
| 6,849,581 B1 * | 2/2005 | Thompson | C11D 3/2075 507/103 |

(Continued)

FOREIGN PATENT DOCUMENTS

| | | |
|---|---|---|
| EP | 0 835 924 A1 | 4/1998 |
| JP | 60-18596 | 1/1985 |

(Continued)

OTHER PUBLICATIONS

International Search Report issued Dec. 3, 2013, in PCT/JP2013/076068, filed Sep. 26, 2013.

(Continued)

*Primary Examiner* — Gregory R Delcotto

(74) *Attorney, Agent, or Firm* — Oblon, McClelland, Maier & Neustadt, L.L.P

(57) ABSTRACT

This invention provides an engine cleaning composition for removing sediment formed in an engine. Such engine cleaning composition comprises: a dispersant containing a carboxylic acid and an amine; a chelating agent; a glycol solvent; and a naphthenic oil.

10 Claims, No Drawings

(56) References Cited

U.S. PATENT DOCUMENTS

| | | | | |
|---|---|---|---|---|
| 2002/0107161 | A1 | 8/2002 | Gatzke | |
| 2003/0158060 | A1 | 8/2003 | Ahmadi et al. | |
| 2005/0250666 | A1* | 11/2005 | Gatlin | C09K 8/38 510/424 |
| 2006/0128589 | A1 | 6/2006 | Shriner | |
| 2009/0258043 | A1* | 10/2009 | Eskuchen | A61K 8/0208 424/401 |

FOREIGN PATENT DOCUMENTS

| | | |
|---|---|---|
| JP | 1-301923 | 12/1989 |
| JP | 06-080995 | 10/1994 |
| JP | 07-166885 | 6/1995 |
| JP | 9-13065 | 1/1997 |
| JP | 9-13066 | 1/1997 |
| JP | 9-13067 | 1/1997 |
| JP | 10-001699 | 1/1998 |
| JP | 2003-214268 | 7/2003 |
| JP | 2004-67977 | 3/2004 |
| JP | 2004-67977 A | 3/2004 |
| JP | 2004-515604 | 5/2004 |
| WO | WO 02/46350 A1 | 6/2002 |

OTHER PUBLICATIONS

Notice of Allowance issued Dec. 2, 2014, in Japanese Patent Application No. 2012-214130 (with English language translation).
Office Action issued Oct. 7, 2014, in Japanese Patent Application No. 2012-214130 (with English language translation).

* cited by examiner

ENGINE CLEANING COMPOSITION

TECHNICAL FIELD

The present invention relates to an engine cleaning composition for removing sediment formed in an engine.

BACKGROUND ART

It is known that engine performance deteriorates when sediment such as sludge is formed inside the engine. Therefore, the inhibition of the sediment formation has been attempted by adding various types of additives to a fuel or a lubricant.

For example, Patent Document 1 discloses a diesel engine lubricant additive consisting of oxycarboxylic acids capable of dispersing water-containing calcium sulfate in oil. Such additive is capable of dispersing calcium sulfate, which is a component of sludge, in a lubricant and is capable of decreasing sludge sedimentation. Also, an apparatus or a composition used for cleaning an engine combustion chamber has been known (for example, Patent Documents 2 and 3).

PRIOR ART DOCUMENTS

Patent Documents

Patent Document 1: JP H9-13065 A (1997)
Patent Document 2: JP H1-301923 A (1989)
Patent Document 3: JP 2003-214268 A

SUMMARY OF THE INVENTION

Object to be Attained by the Invention

The additive disclosed in Patent Document 1 inhibits the sediment formation by dispersing calcium sulfate, which is a component of sediment, in a lubricant, but it is not capable of removing sediment that has already been formed. When the formed sediment is in a solid state, in particular, it is difficult to remove such sediment.

Accordingly, it is an object of the present invention to provide an engine cleaning composition for removing sediment formed in an engine.

Means for Attaining the Object

The present inventors have conducted concentrated studies. As a result, they discovered that the use of a dispersant containing a carboxylic acid and an amine in combination with a chelating agent, a glycol solvent, and a naphthenic oil enables efficient removal of sediment.

Specifically, the present invention encompasses the following.

[1] An engine cleaning composition comprising: a dispersant containing a carboxylic acid and an amine; a chelating agent; a glycol solvent; and a naphthenic oil.

[2] The engine cleaning composition according to [1], wherein the amine is an aliphatic amine represented by a general formula:

$$NR^1R^2R^3$$

[wherein
$R^1$ represents $C_8$ to $C_{18}$ alkyl; and
$R^2$ and $R^3$ each independently represent hydrogen or $C_1$ to $C_3$ alkyl].

[3] The engine cleaning composition according to [2], wherein $R^2$ and $R^3$ are hydrogen.

[4] The engine cleaning composition according to any of [1] to [3], wherein the carboxylic acid is $C_{18}$ to $C_{36}$ aliphatic polycarboxylic acid.

[5] The engine cleaning composition according to any of [1] to [4], wherein the amine value and the acid value of the mixture of the carboxylic acid and the amine contained in the dispersant are 40 to 260 mg KOH/g and 10 to 160 mg KOH/g, respectively.

[6] The engine cleaning composition according to any of [1] to [5], wherein the chelating agent further comprises an amine.

This description includes the content as disclosed in the description and/or drawings of Japanese Patent Application No. 2012-214130, which is a priority document of the present application.

Effects of the Invention

According to the present invention, sediment formed in an engine can be effectively removed.

EMBODIMENTS FOR CARRYING OUT THE INVENTION

<Dispersant>

The dispersant used in the present invention comprises a carboxylic acid and an amine.

The term "cleaning" used herein refers to removal of sediment that has already been formed. While the term "cleansing" is used in Patent Document 1 with reference to the effects of inhibiting sediment formation (i.e., preventive effects), "cleaning" is definitely distinguished from "cleansing" herein. Since the situations, the purposes, the effects, and other conditions relating to the use of a cleaning agent are different from those relating to the use of a cleansing agent, applications thereof can be definitely distinguished from each other.

With the use of the engine cleaning composition containing the dispersant of the present invention, sediment can be removed from the inside of an engine. The type of sediment to be removed is not particularly limited, and sediment in a semi-solid form (viscous form), solid form, or another form can be removed. In particular, it is difficult to remove sediment in a solid form, which is an organic contaminant solidified with heat, according to a conventional technique. Accordingly, the dispersant described above is preferably used for removal of such sediment in a solid form.

The sediment component is not limited to calcium sulfate. The present invention is applicable to a wide variety of sediments formed inside engines.

The term "carboxylic acid" used herein refers to a compound comprising one or more carboxyl groups in a molecule. It is preferably aliphatic carboxylic acid, and it is particularly preferably $C_{18}$ to $C_{36}$ aliphatic carboxylic acid, although carboxylic acid is not particularly limited thereto. In addition, carboxylic acid is preferably polycarboxylic acid comprising two or more (e.g., 2 to 6) carboxyl groups in a molecule, and it is particularly preferably dicarboxylic acid comprising two carboxyl groups in a molecule. Such carboxylic acid may be saturated or unsaturated. Alternatively, carboxylic acid containing no hydroxyl group in its molecule can also be used.

Specific examples of carboxylic acids include dimer acid, ricinoleic acid, citric acid, mellitic acid, gluconic acid, adipic acid, 1,8-octane dicarboxylic acid, 1,10-decane dicarboxylic acid, eicosane diacid, tartaric acid, malic acid, phthalic acid, maleic acid, terephthalic acid, stearic acid, lauric acid, myristic acid, behenic acid, and salicylic acid. A single type of carboxylic acid may be used alone, or two or more types thereof may be used in combination.

In the present invention, an amine is preferably an aliphatic amine. In particular, use of an aliphatic amine represented by the general formula $NR^1R^2R^3$, wherein $R^1$ represents $C_8$ to $C_{18}$ alkyl and $R^2$ and $R^3$ each independently represent hydrogen or $C_1$ to $C_3$ alkyl, is preferable. An aliphatic amine represented by the above formula, wherein $R^1$ represents $C_8$ to $C_{18}$ alkyl and $R^2$ and $R^3$ both represent hydrogen, is particularly excellent in terms of cleaning performance.

Specific examples of amines include octylamine, nonylamine, decylamine, undecylamine, dodecylamine (laurylamine), tridecylamine, tetradecylamine, pentadecylamine, hexadecylamine, heptadecylamine, and octadecylamine (stearylamine). In addition, amines derived from the above compounds by substituting either or both of the hydrogen atoms bound to the nitrogen atom with methyl can also be used. A single type of amine may be used alone, or two or more types thereof may be used in combination.

The dispersant may further comprise a solvent. The solvent type is not particularly limited, and any solvent that is commonly used can be used herein. Use of an organic solvent is particularly preferable. Examples of organic solvents include aromatic oil, xylene, mineral spirit, isoparaffin, hexane, and butyl cellosolve. A single type of solvent may be used alone, or two or more types thereof may be used in combination.

The amine value and the acid value of the dispersant can be adjusted within a certain range, so that cleaning performance can further be improved.

Specifically, the amine value of the dispersant is preferably 20 to 130 mg KOH/g, more preferably 50 to 120 mg KOH/g, and particularly preferably 80 to 110 mg KOH/g. The acid value thereof is preferably 5 to 80 mg KOH/g, more preferably 10 to 60 mg KOH/g, and particularly preferably 15 to 40 mg KOH/g. The amine value and the acid value of the dispersant can vary in accordance with the presence of optional components other than carboxylic acid and amine.

The amine value of a mixture of carboxylic acid and amine contained in the dispersant is preferably 40 to 260 mg KOH/g, more preferably 100 to 240 mg KOH/g, and particularly preferably 160 to 220 mg KOH/g. The acid value thereof is preferably 10 to 160 mg KOH/g, more preferably 20 to 120 mg KOH/g, and particularly preferably 30 to 80 mg KOH/g.

The amine value can be determined in accordance with the method defined in JIS K 7237, and the acid value can be determined in accordance with the method defined in JIS K 0070.

The ratio of carboxylic acid to amine is preferably 1:0.5 to 1:4 by weight, and it is particularly preferably 1:1 to 1:3 by weight.

The total amount of carboxylic acid and amine contained in the dispersant is preferably 20% to 80% by weight, more preferably 30% to 70% by weight, and particularly preferably 40% to 60% by weight.

<Engine Cleaning Composition>

The present invention relates to an engine cleaning composition containing the dispersant described above. The engine cleaning composition of the present invention comprises, in addition to the dispersant, a chelating agent, a glycol solvent, and a naphthenic oil. With the use of such components in combination, cleaning performance can be exerted. The composition may contain other components, provided that the effects of the present invention are not adversely affected.

The type of chelating agent is not particularly limited, and any chelating agent that is commonly used can be used herein. For example, aminocarboxylate can be used as a chelating agent. Examples of aminocarboxylate include ethylenediaminetetraacetate, nitrilotriacetate, diethylenetriaminepentaacetate, and hydroxyethylethylenediaminetriacetate. A single type of chelating agent may be used alone, or two or more types thereof may be used in combination.

The amount of the chelating agent contained in the engine cleaning composition is preferably 3% to 30% by weight, more preferably 4% to 20% by weight, and particularly preferably 5% to 10% by weight.

The type of glycol solvent is not particularly limited, and any glycol solvent that is commonly used can be used herein. Examples of glycol solvents include ethylene oxide (E.O.)-based glycol ether, propylene oxide (P.O.)-based glycol ether, and dialkyl glycol ether.

Examples of E.O.-based glycol ethers include methyl glycol (MG), methyl diglycol (MDG), methyl triglycol (MTG), methyl polyglycol (MPG), isopropyl glycol (iPG), isopropyl diglycol (iPDG), butyl glycol (BG), butyl diglycol (BDG), butyl triglycol (BTG), isobutyl glycol (iBG), isobutyl diglycol (iBDG), hexyl glycol (HeG), hexyl diglycol (HeDG), 2-ethyl hexyl glycol (EHG), 2-ethyl hexyl diglycol (EHDG), allyl glycol (AG), allyl glycol-H (AG-H), phenyl glycol (PhG), phenyl diglycol (PhDG), phenyl glycol-H (PhG-H), benzyl glycol (BzG), and benzyl diglycol (BzDG).

Examples of P.O.-based glycol ethers include methyl propylene glycol (MFG), methyl propylene diglycol (MFDG), methyl propylene triglycol (MFTG), propyl propylene glycol (PFG), propyl propylene diglycol (PFDG), butyl propylene glycol (BFG), butyl propylene diglycol (BFDG), butyl propylene triglycol (BFTG), phenyl propylene glycol (PhFG), and methyl propylene glycol acetate (MFG-AC).

Examples of dialkyl glycol ethers include dimethyl glycol (DMG), dimethyl diglycol (DMDG), dimethyl triglycol (DMTG), methyl ethyl diglycol (MEDG), diethyl diglycol (DEDG), dibutyl diglycol (DBDG), and dimethyl propylene diglycol (DMFDG).

Further examples include ethylene glycol (EG) and propylene glycol (PG).

In particular, use of a glycol solvent compatible with the engine cleaning composition is preferable. With the use of such glycol solvent, the engine cleaning composition can sufficiently exert cleaning effects.

Also, the boiling point of a glycol solvent is preferably 220° C. or higher, more preferably 250° C. or higher, and particularly preferably 270° C. or higher. The upper limit of the boiling point is, for example, 400° C., 370° C., or 340° C. Since such glycol solvent does not evaporate at high temperatures, a dispersant and a chelating agent can be prevented from gelling. Thus, cleaning effects of the engine cleaning composition can be retained.

A single type of glycol solvent may be used alone, or two or more types thereof may be used in combination.

The amount of the glycol solvent contained in the engine cleaning composition is preferably 30% to 80% by weight, more preferably 35% to 70% by weight, and particularly preferably 40% to 60% by weight.

The type of naphthenic oil is not particularly limited, and any naphthenic oil that is commonly used can be used herein. For example, the kinematic viscosity of naphthenic oil at 40° C. is preferably 5 to 50 $mm^2/s$, more preferably 5 to 30 $mm^2/s$, and particularly preferably 5 to 15 $mm^2/s$. A single type of naphthenic oil may be used alone, or two or more types thereof may be used in combination.

The amount of naphthenic oil contained in the engine cleaning composition is preferably 10% to 50% by weight, more preferably 15% to 40% by weight, and particularly preferably 20% to 30% by weight.

The total amount of carboxylic acid and amine contained in the dispersant is preferably 3% to 30% by weight, more preferably 4% to 20% by weight, and particularly preferably 5% to 10% by weight, based on the engine cleaning composition.

The engine cleaning composition of the present invention may further comprise other components, provided that the effects of the present invention are not adversely affected.

<Flushing Oil>

The engine cleaning composition of the present invention can be mixed with flushing oil, which is compatible with the composition. When the engine is to be cleaned with the use of the engine cleaning composition, the engine needs to be disassembled before cleaning. When the engine cleaning composition is mixed and used in combination with flushing oil, however, the mixture may be injected into the engine instead of an engine oil, the engine may be operated for a given period of time, and sediment formed inside the engine may then be removed. Since this method does not require engine disassembly, sediment can be easily removed.

Flushing oil comprises an ashless dispersant, a metal cleanser, a zinc dialkyldithiophosphate, an antifoaming agent, and base oil. Flushing oil may further comprise other components, provided that the effects of the engine cleaning composition of the present invention are not adversely affected.

The type of ashless dispersant is not particularly limited, and any ashless dispersant that is commonly used can be used herein. Examples of ashless dispersants include succinimide, succinic acid ester, benzyl amine, succinamide, and copolymers. A single type of ashless dispersant may be used alone, or two or more types thereof may be used in combination.

The type of metal cleanser is not particularly limited, and any metal cleanser that is commonly used can be used herein. An example of a metal cleanser is an alkaline-earth metal salt of an organic acid. Specific examples include neutral or perbasic metal (Ba, Ca, or Mg) sulfonate, perbasic metal (Ba, Ca, or Mg) phenate, perbasic metal (Ca or Mg) salicylate, and phosphonate. A single type of metal cleanser may be used alone, or two or more types thereof may be used in combination.

A single type of zinc dialkyldithiophosphate may be used alone, or two or more types thereof may be used in combination.

The type of antifoaming agent is not particularly limited, and any antifoaming agent that is commonly used can be used herein. Examples of antifoaming agents include silicone oil, oil alcohol, cetyl alcohol, tributyl phosphate, higher alcohol, alkyl ester, and polymethacrylate. A single type of antifoaming agent may be used alone, or two or more types thereof may be used in combination.

The type of base oil is not particularly limited, provided that it is compatible with the engine cleaning composition of the present invention. Examples of base oil include natural mineral oil and synthetic oil. Specific examples include paraffin-based hydrocarbon, aromatic hydrocarbon, naphthene-based hydrocarbon, olefin oligomer, polybutene, alkylbenzene, cycloalkanes, diester, polyol ester, phosphoric ester, polyglycol, phenyl ether, polysiloxane, silicate ester, and halocarbon. A single type of base oil may be used alone, or two or more types thereof may be used in combination.

The flushing oil preferably has a viscosity index of 150 or less. More specifically, the viscosity index is preferably 0 to 150, more preferably 30 to 140, further preferably 60 to 130, and still further preferably 90 to 120. The viscosity index can be determined in accordance with the method defined in JIS K 2283. With the use of flushing oil having a viscosity index in the range described above, compatibility with the engine cleaning composition can further be improved.

The phosphorus content of the flushing oil is preferably 0.09% by weight or more. More specifically, the phosphorus content is preferably 0.09 to 1% by weight, more preferably 0.1 to 0.5% by weight, and further preferably 0.11 to 0.2% by weight. By increasing the phosphorus content, engine wear can be prevented.

The engine cleaning composition of the present invention can be used in combination with the flushing oil. The engine cleaning composition and the flushing oil can be provided in the form of an engine cleaning compound comprising a mixture of the engine cleaning composition and the flushing oil. The ratio of the engine cleaning composition to the flushing oil in the compound is preferably 5:1 to 1:1, and particularly preferably 4:1 to 2:1, by volume, for example. The phosphorus content in the engine cleaning compound is, for example, 0.025% by weight or more, more specifically 0.025% to 0.3% by weight, and further specifically 0.03% to 0.1% by weight.

The engine cleaning composition and the flushing oil can be provided in the form of an engine cleaning kit comprising the engine cleaning composition and the flushing oil separately. A user can adequately mix the engine cleaning composition and the flushing oil included in the kit immediately before use. It is preferable that the kit comprise the engine cleaning composition and the flushing oil in such a manner that phosphorus content in the engine cleaning compound obtained by mixing the engine cleaning composition with the flushing oil is, for example, 0.025% by weight or more, more specifically 0.025% to 0.3% by weight, and further specifically 0.03% to 0.1% by weight.

<Method of Engine Cleaning>

With the use of the engine cleaning composition of the present invention, sediment can be removed from the engine. The form of sediment is not limited to a semi-solid form, and sediment may be in a solid form, which is difficult to remove.

Engine cleaning can be performed by applying the engine cleaning composition to an engine that has been disassembled and removed. The method of cleaning is not particularly limited, provided that the engine cleaning composition is brought into contact with the engine. For example, the engine may be immersed in a vessel containing the engine cleaning composition. By performing the cleaning at high temperatures, also, cleaning efficiency can be enhanced. For example, cleaning is carried out preferably at 50° C. to 200° C., more preferably at 70° C. to 150° C., and further preferably at 90° C. to 120° C.

The engine cleaning compound comprising a mixture of the engine cleaning composition and the flushing oil can be injected directly into the engine instead of the engine oil. By operating the engine for a given period of time, sediment formed in the engine can be removed. It is not necessary to disassemble and remove the engine according to this embodiment. Thus, the cleaning procedure can be remarkably simplified. Since engine disassembly is not necessary, also, engine damage can be prevented. Because of the simplicity of the cleaning procedure, further, a general user can perform cleaning by him/herself without relying on an expert.

The duration of engine operation for cleaning varies in accordance with the condition and the amount of sediment. For example, it is preferably 1 to 10 hours, more preferably 1.5 to 7 hours, and further preferably 2 to 4 hours.

Also, the engine cleaning composition may be sprayed directly into a combustion chamber, so that sediment formed inside the combustion chamber may be removed. Also, spraying of the engine cleaning composition into the combustion chamber may be performed in combination with the injection of the engine cleaning compound into the engine, so that sediment can be removed from the crankcase and the combustion chamber at the same time.

EXAMPLES

The present invention is described in greater detail with reference to the following examples and comparative examples, although the technical scope of the present invention is not limited to these examples.

<Preparation of Dispersant>

(1) Laurylamine (20 parts by weight), dimer acid (29 parts by weight), and aromatic oil (51 parts by weight) were mixed while being agitated at 60° C. for 3 hours. The resulting dispersant (o) exhibited an amine value of 56 mg KOH/g and an acid value of 59 mg KOH/g.

(2) Dispersants (p) to (x) were prepared in the manner described above. The compositions, the amine values, and the acid values of the dispersants are shown in Table 1. Dispersant (n) is Floren G-600, manufactured by Kyoeisha Chemical Co., Ltd. The dimer acid is a dimer of conjugated linoleic acid.

TABLE 1

| | Solvent (wt %) | Amine (wt %) | Carboxylic acid (wt %) | Amine value | Acid value | Cleaning performance |
|---|---|---|---|---|---|---|
| Dispersant (n) | Xylene/aromatic oil (—) | — | — | 58 | 59 | 2 h |
| Dispersant (o) | Aromatic oil (51 wt %) | Laurylamine (20 wt %) | Dimer acid (29 wt %) | 56 | 59 | 2 h |
| Dispersant (p) | Aromatic oil (51 wt %) | Dimethyl laurylamine (21 wt %) | Dimer acid (28 wt %) | 55 | 58 | 6 h |
| Dispersant (q) | Aromatic oil (51 wt %) | Dimethyl laurylamine (21 wt %) | Dimer acid (28 wt %) | 56 | 58 | 6 h |
| Dispersant (r) | Aromatic oil (51 wt %) | Dimethyl laurylamine (30 wt %) | Dimer acid (19 wt %) | 73 | 38 | 6 h |
| Dispersant (s) | Aromatic oil (51 wt %) | Dimethyl laurylamine (37 wt %) | Dimer acid (12 wt %) | 92 | 24 | 4 h |
| Dispersant (t) | Aromatic oil (51 wt %) | Laurylamine (20 wt %) | Dimer acid (29 wt %) | 54 | 58 | 2 h |
| Dispersant (u) | Aromatic oil (51 wt %) | Laurylamine (28 wt %) | Dimer acid (21 wt %) | 80 | 40 | 1.5 h |
| Dispersant (v) | Aromatic oil (51 wt %) | Laurylamine (35 wt %) | Dimer acid (14 wt %) | 103 | 24 | 1 h |
| Dispersant (w) | Aromatic oil (51 wt %) | Dimethyl laurylamine (40 wt %) | Dimer acid (9 wt %) | 99 | 18 | 4 h |
| Dispersant (x) | Aromatic oil (51 wt %) | Dimethyl laurylamine (44 wt %) | Dimer acid (5 wt %) | 109 | 10 | 4 h |

<Cleaning Test 1>

The dispersants prepared above were mixed with naphthenic oil, glycol solvents (HeG), and chelating agents at proportions shown in Table 2, so as to prepare cleaning compositions. The chelating agent (b) is MZ-2, manufactured by Chubu Chelest Co., Ltd., and the solvent content is 35% by weight.

TABLE 2

| | |
|---|---|
| Dispersant | 12 wt % |
| Naphthenic oil | 24 wt % |
| HeG | 48 wt % |
| Chelating agent (b) | 16 wt % |

The oil ring of the piston in the gasoline engine to which the sediment had adhered was immersed in the cleaning composition, and the resultant was then allowed to stand at 100° C. The time necessary for the sediment to be completely removed was measured. The results in terms of cleaning performance are shown in Table 1.

The effects of the dispersant were examined in the manner described above. Without the use of Dispersant (n), as shown in Table 3, sediment was not removed from the oil ring after the elapse of 11 hours or longer. The chelating agent (a) is MZ-8, manufactured by Chubu Chelest Co., Ltd., and the solvent content is 50% by weight.

TABLE 3

| | Dispersant (n) | Naphthenic oil | HeDG | Chelating agent (a) | Cleaning performance |
|---|---|---|---|---|---|
| Ex. | 12 wt % | 20 wt % | 48 wt % | 20 wt % | 9 h |
| Comp. Ex. | — | 20 wt % | 48 wt % | 32 wt % | x(>11 h) |

<Cleaning Test 2>

The oil ring of the piston in the gasoline engine to which the sediment had adhered was immersed in the cleaning composition, and the resultant was then allowed to stand at 100° C. for 1 to 9 hours. Sediment removal was visually observed. The results are shown in Table 4 and Table 5 (◎: removal efficiency of 100%; ○: removal efficiency of 50% or more; Δ: removal efficiency of less than 50%; x: removal efficiency of 0%). The chelating agent (c) is a mixture of ethylenediaminetetraacetic acid, dibutyl amine, and a solvent (ethylene glycol), and the solvent content is 59% by weight.

In Examples 1 to 8 in which the dispersant was used in combination with the chelating agent, sediment removal was observed within 9 hours. In Comparative Examples 1 and 2 in which the dispersant was not used in combination with the chelating agent, sediment was not removed after the elapse of 9 hours.

TABLE 4

| | Ex. 1 | Ex. 2 | Ex. 3 | Ex. 4 | Ex. 5 | Ex. 6 | Ex. 7 | Ex. 8 |
|---|---|---|---|---|---|---|---|---|
| Naphthenic oil | 20 | 20 | 20 | 20 | 20 | 24 | 24 | 24 |
| HeDG | 48 | 53 | 58 | 48 | — | — | — | — |
| HeG | — | — | — | — | 48 | 48 | 48 | 48 |
| Dispersant (n) | 12 | 12 | 12 | 12 | 12 | 12 | 12 | 12 |
| Chelating agent (a) | 20 | 15 | 10 | 20 | 20 | — | — | — |
| Chelating agent (b) | — | — | — | — | — | 16 | 16 | — |
| Chelating agent (c) | — | — | — | — | — | — | — | 16 |
| Total (wt %) | 100 | 100 | 100 | 100 | 100 | 100 | 100 | 100 |
| Test duration | 9 h | 9 h | 9 h | 3 h | 3 h | 3 h | 1 h | 1 h |
| Result of removal | ◎ | ◎ | Δ | Δ | Δ | ◎ | ○ | ◎ |

TABLE 5

| | Comp. Ex. 1 | Comp. Ex. 2 |
|---|---|---|
| Naphthenic oil | 20 | 20 |
| HeDG | 48 | 48 |
| Dispersant (n) | — | 32 |
| Chelating agent (a) | 32 | — |
| Total (wt %) | 100 | 100 |
| Test duration | 9 h | 9 h |
| Result of removal | x | x |

All publications, patents, and patent applications cited herein are incorporated herein by reference in their entirety.

The invention claimed is:

1. An engine cleaning composition comprising:

a dispersant containing a carboxylic acid and an amine;

a chelating agent;

a glycol solvent; and a naphthenic oil, wherein the carboxylic acid is $C_{18}$ to $C_{36}$ aliphatic polycarboxylic acid.

2. The engine cleaning composition according to claim 1, wherein the amine is an aliphatic amine represented by a general formula:

$$NR^1R^2R^3$$

wherein $R^1$ represents $C_8$ to $C_{18}$ alkyl; and $R^2$ and $R^3$ each independently represent hydrogen or $C_1$ to $C_3$ alkyl.

3. The engine cleaning composition according to claim 2, wherein $R^2$ and $R^3$ are hydrogen.

4. The engine cleaning composition according to claim 1, wherein the amine value and the acid value of the mixture of the carboxylic acid and the amine contained in the dispersant are 40 to 260 mg KOH/g and 10 to 160 mg KOH/g, respectively.

5. The engine cleaning composition according to claim 1, wherein the chelating agent further comprises an amine.

6. The engine cleaning composition according to claim 2, wherein the amine value and the acid value of the mixture of the carboxylic acid and the amine contained in the dispersant are 40 to 260 mg KOH/g and 10 to 160 mg KOH/g, respectively.

7. The engine cleaning composition according to claim 2, wherein the chelating agent further comprises an amine.

8. The engine cleaning composition according to claim 3, wherein the amine value and the acid value of the mixture of the carboxylic acid and the amine contained in the dispersant are 40 to 260 mg KOH/g and 10 to 160 mg KOH/g, respectively.

9. The engine cleaning composition according to claim 3, wherein the chelating agent further comprises an amine.

10. The engine cleaning composition according to claim 4, wherein the chelating agent further comprises an amine.

* * * * *